US008887325B2

(12) United States Patent
Antoniello

(10) Patent No.: US 8,887,325 B2
(45) Date of Patent: Nov. 18, 2014

(54) OVERFLOW ADAPTER

(71) Applicant: Frank Antoniello, Commack, NY (US)

(72) Inventor: Frank Antoniello, Commack, NY (US)

( * ) Notice: Subject to any disclaimer, the term of this patent is extended or adjusted under 35 U.S.C. 154(b) by 0 days.

(21) Appl. No.: 14/215,391

(22) Filed: Mar. 17, 2014

(65) Prior Publication Data

US 2014/0259386 A1 Sep. 18, 2014

Related U.S. Application Data

(60) Provisional application No. 61/802,119, filed on Mar. 15, 2013.

(51) Int. Cl.
*E03C 1/244* (2006.01)
*E03C 1/24* (2006.01)

(52) U.S. Cl.
CPC .. *E03C 1/244* (2013.01); *E03C 1/24* (2013.01)
USPC ..... 4/694

(58) Field of Classification Search
CPC ..... E03C 1/24; E03C 1/244
USPC ..... 4/679, 680, 694, 293
See application file for complete search history.

(56) References Cited

U.S. PATENT DOCUMENTS 5,025,509 A * 6/1991 Holt et al. ..... 4/694
6,216,288 B1 * 4/2001 Bernau ..... 4/694
7,096,522 B2 * 8/2006 Hirtriter ..... 4/694

* cited by examiner

*Primary Examiner* — Tuan N Nguyen
(74) *Attorney, Agent, or Firm* — Harvey Lunenfeld

(57) ABSTRACT

Overflow adapter for raising fluid discharge overflow level of a drain overflow having a drain overflow discharge entrance and a substantially centrally disposed drain overflow connector, the drain overflow installed in a plumbing fixture having a drain, the drain overflow having an optional drain control attached to and working in conjunction with the substantially centrally disposed drain overflow connector, the optional drain control for opening and closing the drain, comprising: an overflow disk having an upper overflow disk discharge opening having opposing substantially concentric arcuate edges and opposing edges transverse to the opposing substantially concentric arcuate edges, an overflow plate having an upper overflow plate hole at least as large as the upper overflow disk discharge opening, a shaft, and a cover or handle fastened to and working in conjunction with the shaft when the optional drain control is installed in the drain overflow for opening and closing the drain.

10 Claims, 18 Drawing Sheets

OVERFLOW ADAPTER

This application claims the benefit of U.S. Provisional Application No. 61/802,119, filed Mar. 15, 2013, the full disclosure of which is incorporated herein by reference.

BACKGROUND OF THE INVENTION

1. Field of the Invention

The present invention relates generally to drain overflow devices and more particularly to overflow adapters.

2. Background Art

Showers, bathtubs, sinks, and the like typically have drain overflow devices that limit the maximum height of water and/or wastewater in the showers, bathtubs, sinks, and the like. These drain overflow devices typically allow the height of the water and/or wastewater to rise to a fixed level, prior to commencement of discharge of the water and/or wastewater. Such drain overflow devices are often intended to prevent undesirable discharge of water and/or wastewater over walls and/or sides of the showers, bathtubs, sinks, and the like.

It is often desirable to raise the allowable height of the water and/or wastewater in the showers, bathtubs, sinks, and the like above that which is allowed by already installed drain overflow devices, while still preventing the undesirable discharge of water and/or wastewater over walls and/or sides of the showers, bathtubs, sinks, and the like.

There is thus a need for an overflow adapter to raise the allowable height of the water and/or wastewater in the showers, bathtubs, sinks, and the like above that which is allowed by already installed drain overflow devices, while still preventing the undesirable discharge of water and/or wastewater over walls and/or sides of the showers, bathtubs, sinks, and the like. The overflow adapter should be adapted to be used with a variety of drain overflow devices and be capable of being installed as a retrofit in existing installations and/or in new installations. The overflow adapter should be quick, easy, and convenient to install, long lasting, inexpensive to manufacture, sturdy, durable, and of simple construction.

SUMMARY

The present invention is directed to an overflow adapter, which is adapted to raise the allowable height of the water and/or wastewater in plumbing fixtures, including showers, bathtubs, sinks, and the like above that which is allowed by already installed drain overflow devices, while still preventing the undesirable discharge of water and/or wastewater over walls and/or sides of the plumbing fixtures, including showers, bathtubs, sinks, and the like. The overflow adapter is adapted to be used with a variety of drain overflow devices, and may be used to retrofit existing installations and/or installed in new installations. The overflow adapter is quick, easy, and convenient to install, long lasting, inexpensive to manufacture, sturdy, durable, and of simple construction.

An overflow adapter having features of the present invention comprises: an overflow adapter for raising a fluid discharge overflow level of a drain overflow having a drain overflow discharge entrance and a substantially centrally disposed drain overflow connector, the drain overflow installed in a plumbing fixture having a drain, an interior wall having a plumbing fixture overflow exit, and wall edges adjacent the plumbing fixture overflow exit, the drain overflow having an optional drain control attached to and working in conjunction with the substantially centrally disposed drain overflow connector, the optional drain control for opening and closing the drain, the overflow adapter comprising:

an overflow disk having an upper overflow disk discharge opening and a substantially centrally disposed overflow disk hole, the upper overflow disk discharge opening having opposing substantially concentric arcuate edges and opposing transverse edges transverse to the opposing substantially concentric arcuate edges, the opposing substantially concentric arcuate edges and the opposing transverse edges defining the upper overflow disk discharge opening;

an overflow plate having an upper overflow plate hole at least as large as the upper overflow disk discharge opening of the overflow disk, and a substantially centrally disposed overflow plate hole;

overflow adapter fasteners fastening the overflow plate to the drain overflow and sandwiching the overflow disk between the overflow plate and the wall edges adjacent the plumbing fixture overflow exit, the upper overflow disk discharge opening aligned with the upper overflow plate hole, which is at least as large as the upper overflow disk discharge opening, causing any fluid discharge to be discharged through the upper overflow plate hole, through the upper overflow disk discharge opening, thus raising the fluid discharge overflow level of the drain overflow, through the plumbing fixture overflow exit, and into the drain overflow discharge entrance;

a shaft having opposing ends, the shaft inserted through the substantially centrally disposed overflow plate hole, through the substantially centrally disposed overflow disk hole, one of the opposing ends of the shaft fastened to the substantially centrally disposed drain overflow connector;

a cover fastened to the shaft at another of the opposing ends of the shaft, the cover covering the overflow plate, the overflow disk, the wall edges adjacent the plumbing fixture overflow exit, and the drain overflow, the cover comprising a handle fastened to and working in conjunction with the shaft when the optional drain control is installed in the drain overflow, the substantially centrally disposed drain overflow connector, and the optional drain control used for opening and closing the drain.

The plumbing fixture may comprise a shower, a bathtub, a sink, and the like.

DRAWINGS

These and other features, aspects, and advantages of the present invention will become better understood with regard to the following description, appended claims, and accompanying drawings where:

Figure 1:
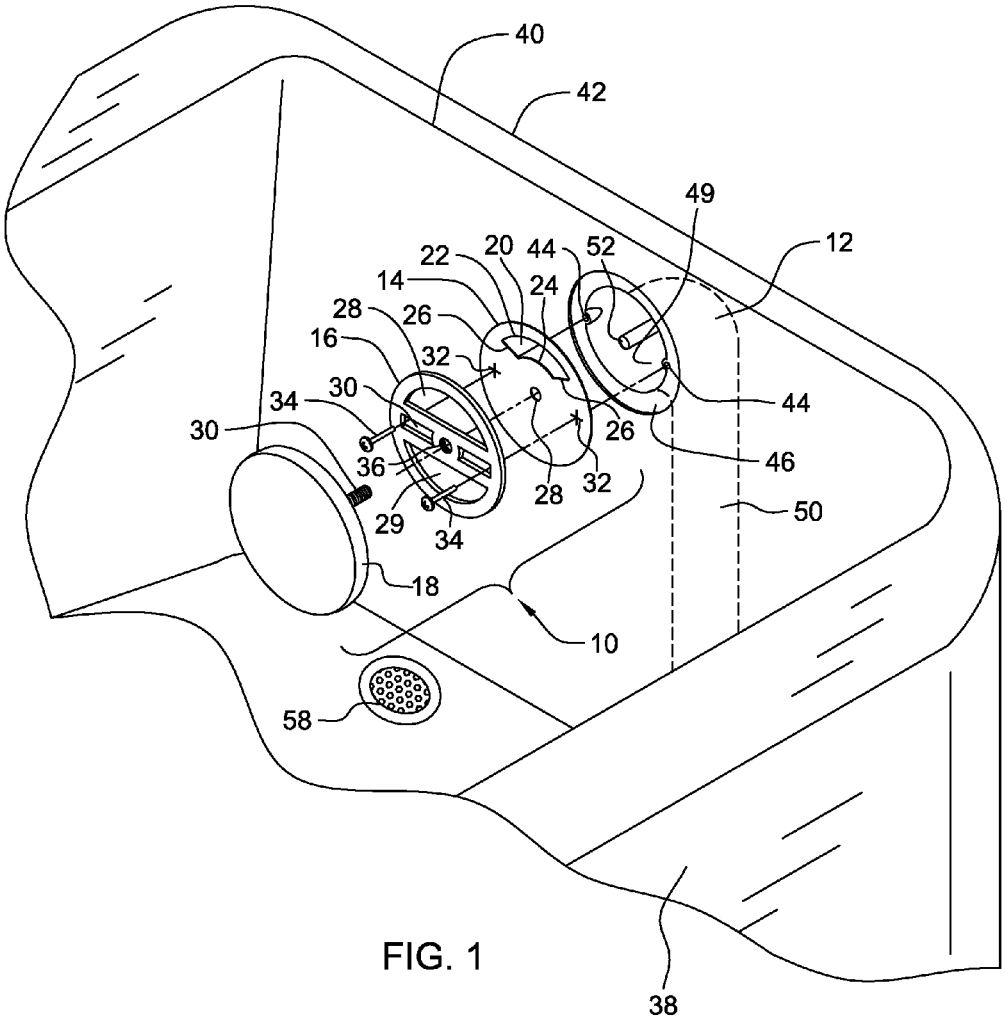
FIG. 1 is an exploded perspective view of an overflow adapter and a drain overflow installed in a bathtub, the overflow adapter constructed in accordance with the present invention.
Figure 2:
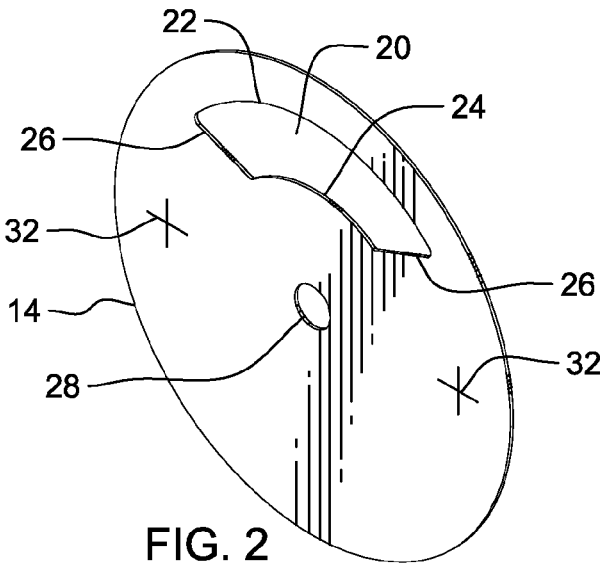
FIG. 2 is a perspective view of an overflow disk of FIG. 1.
Figure 3:
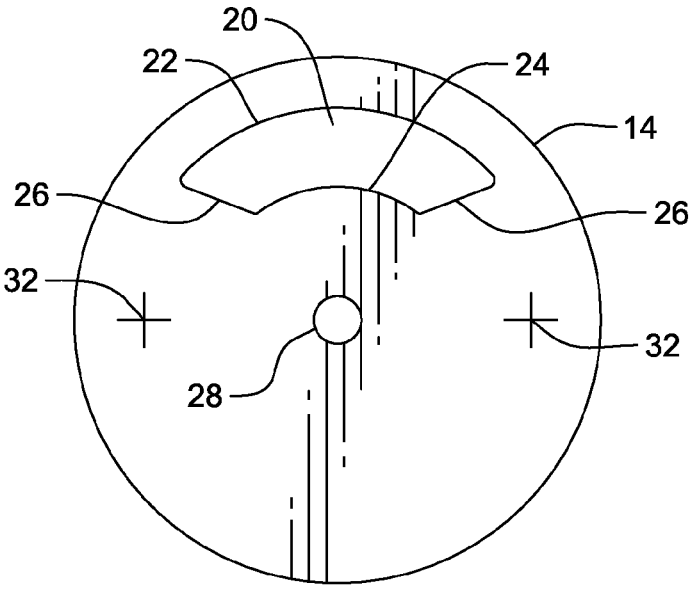
FIG. 3 is a front view of the overflow disk of FIG. 1.
Figure 4:
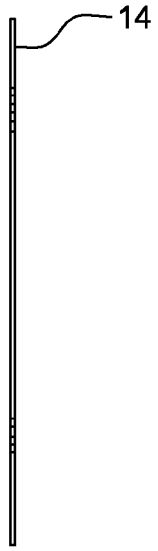
FIG. 4 is a side view of the overflow disk of FIG. 1.
Figure 5:
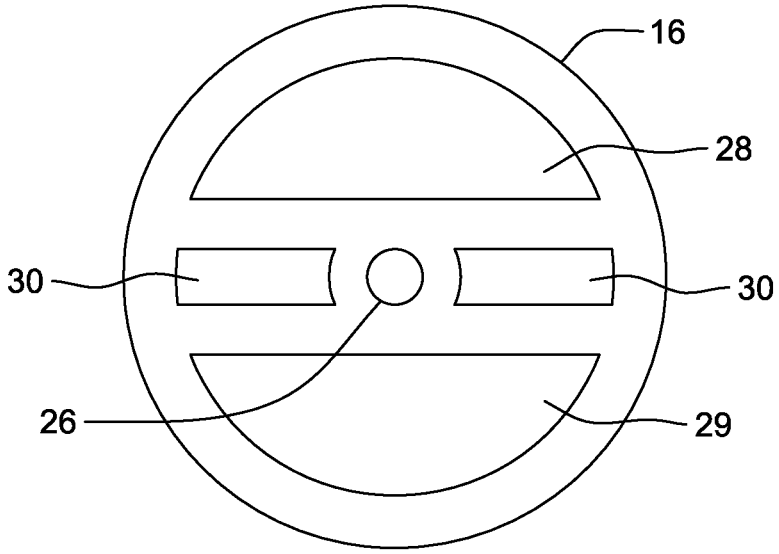
FIG. 5 is a front view of an overflow plate of FIG. 1.
Figure 6:
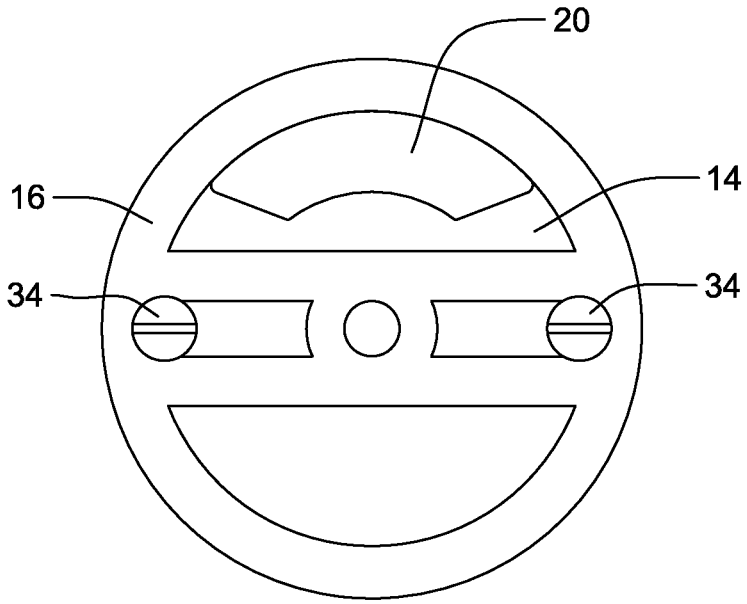
FIG. 6 is a front view of the overflow plate of FIG. 1 mounted on the overflow disk of FIG. 1.
Figure 7:
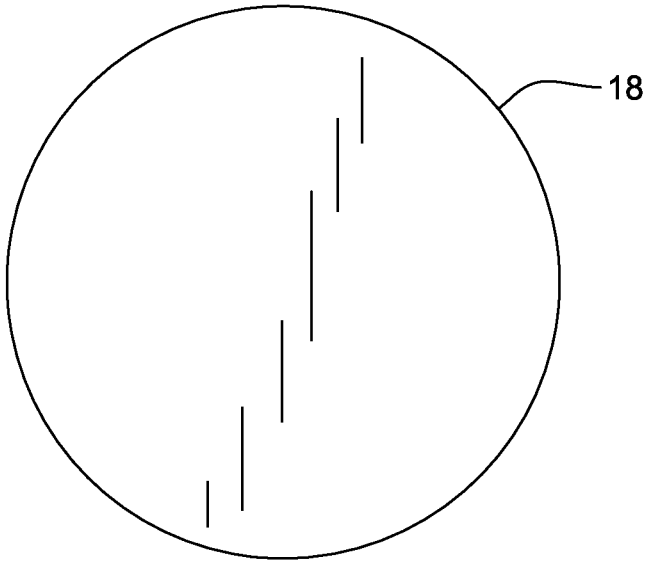
FIG. 7 is a front view of a trim plate of the overflow adapter of FIG. 1.
Figure 8:
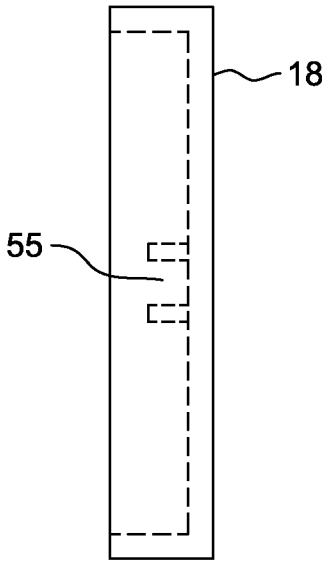
FIG. 8 is a side view of the trim plate of the overflow adapter of FIG. 1.
Figure 9:
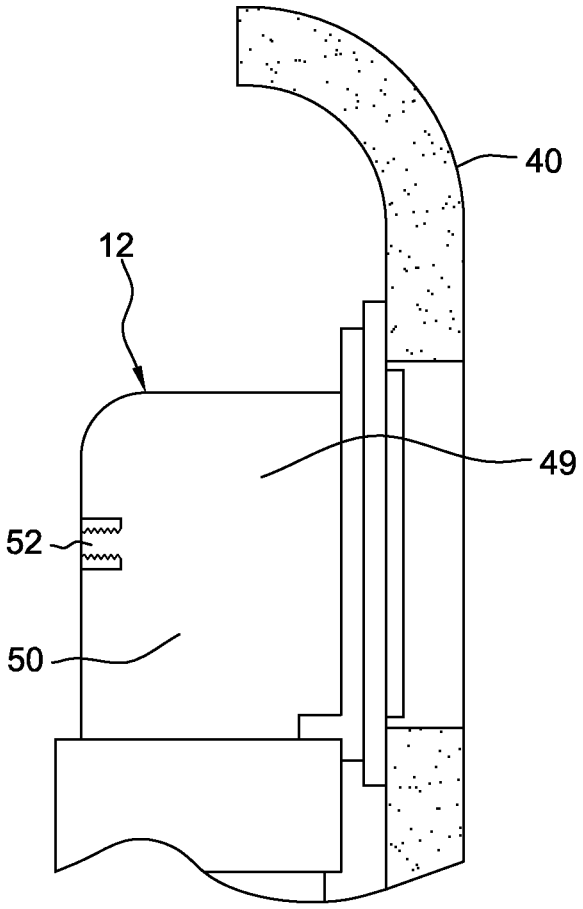
FIG. 9 is a side view of the drain overflow of FIG. 1.
Figure 10:
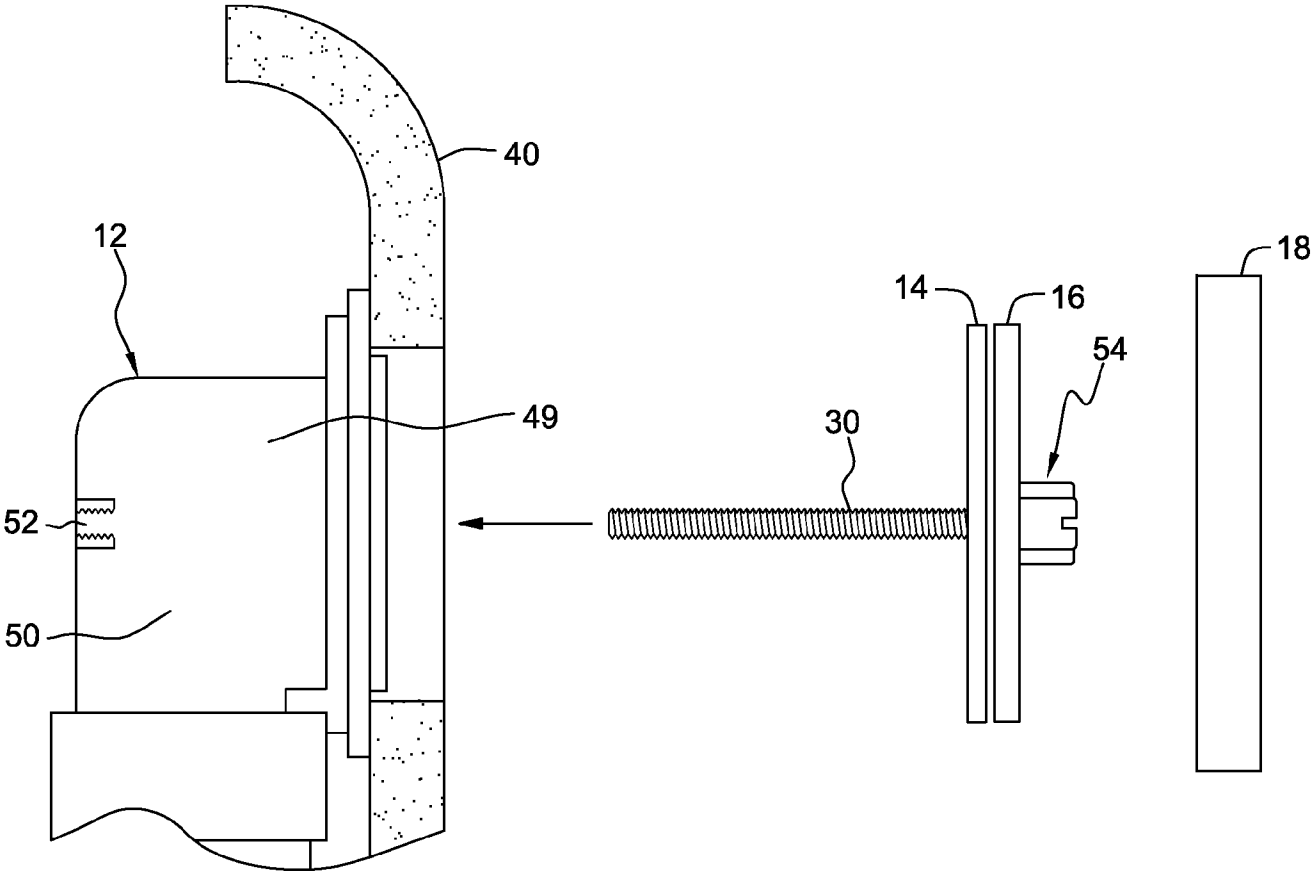
FIG. 10 is a side view of the overflow plate, the overflow disk, fasteners, and trim cap of the overflow adapter of FIG. 1 as the overflow adapter is being fastened to the drain overflow of FIG. 1.
Figure 11:
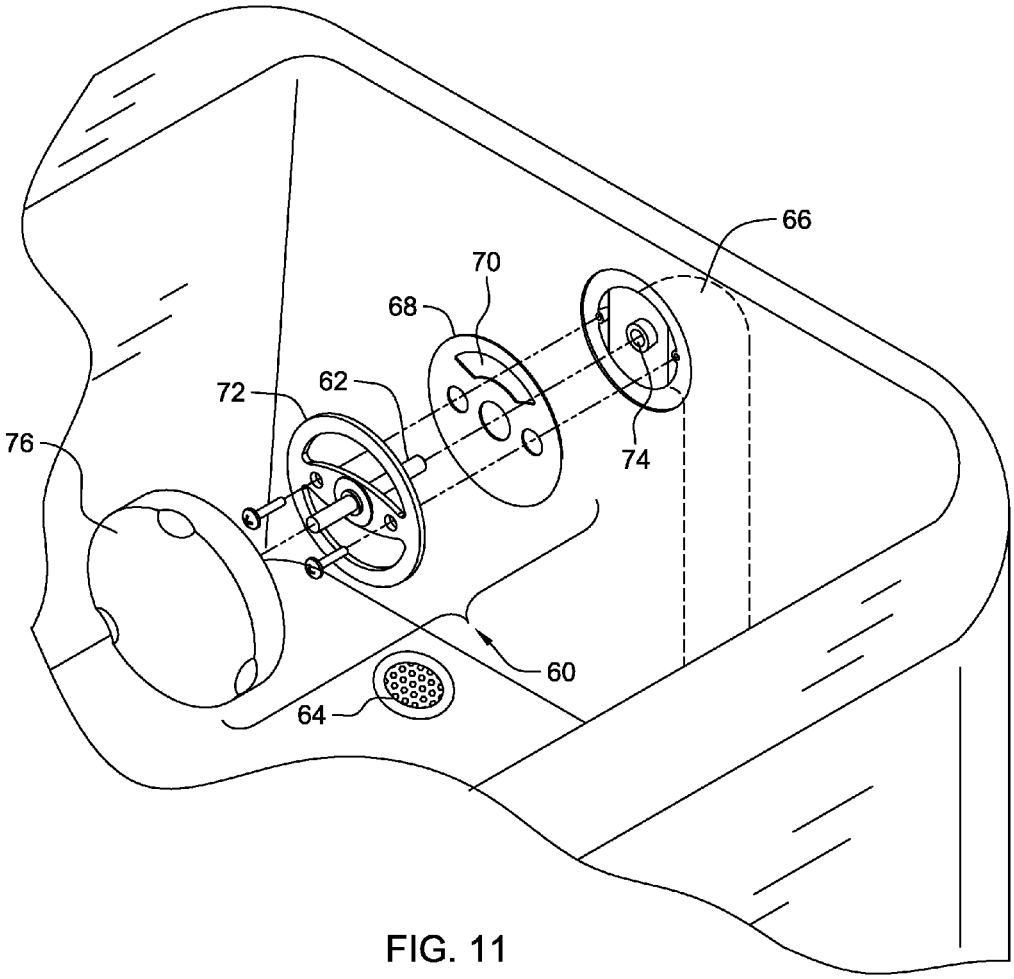
FIG. 11 is an exploded perspective view of an alternate embodiment of an overflow adapter and an alternate embodiment of a drain overflow installed in another bathtub.
Figure 12:
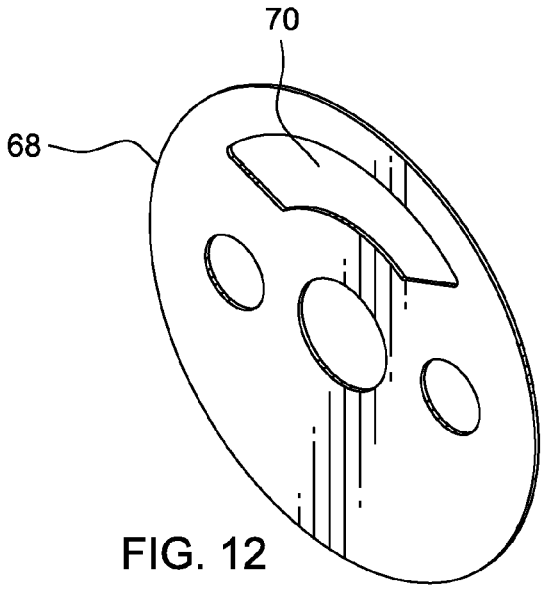
FIG. 12 is a perspective view of an overflow disk of FIG. 11.
Figure 13:
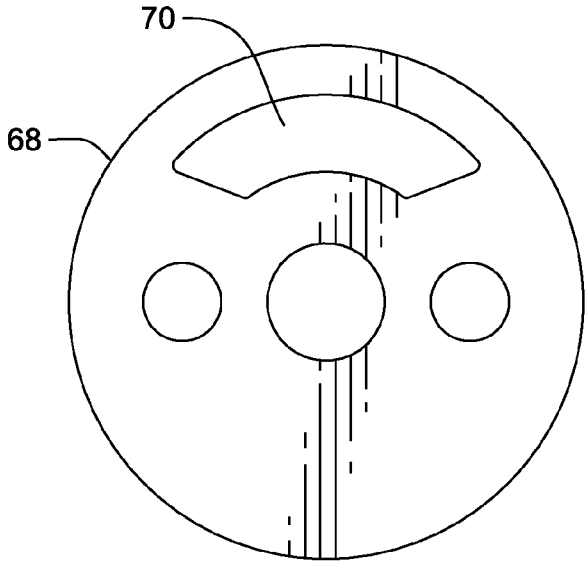
FIG. 13 is a front view of the overflow disk of FIG. 11.
Figure 14:
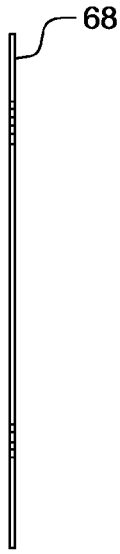
FIG. 14 is a side view of the overflow disk of FIG. 11.
Figure 15:
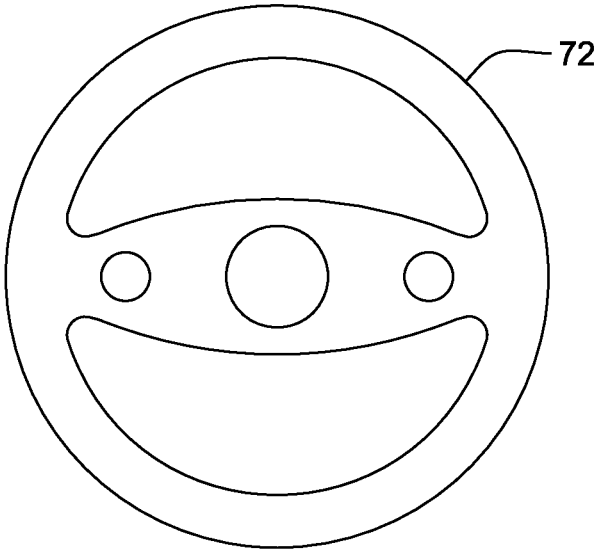
FIG. 15 is a front view of an overflow plate of FIG. 11.
Figure 16:
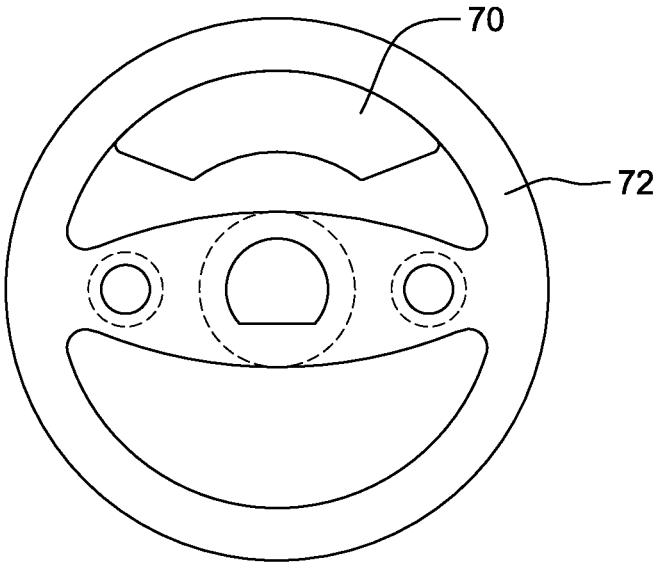
FIG. 16 is a front view of the overflow plate of FIG. 11 mounted on the overflow disk of FIG. 11.
Figure 17:
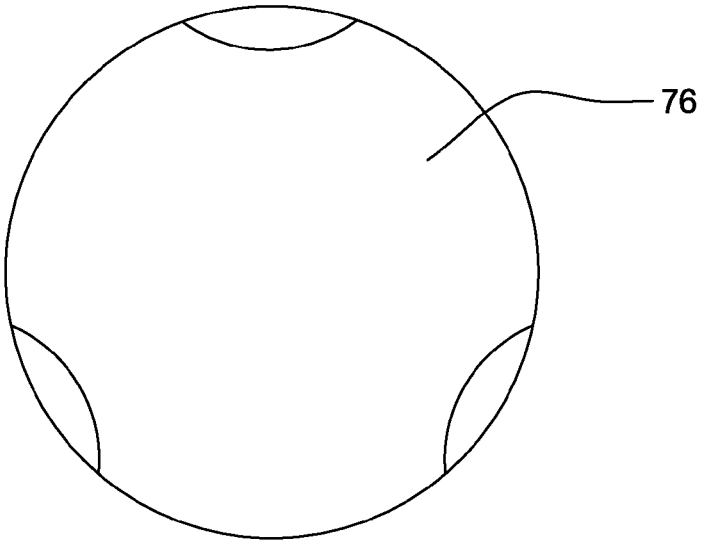
FIG. 17 is a front view of a handle of the overflow adapter of FIG. 11.
Figure 18:
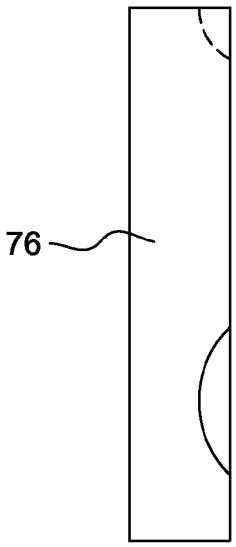
FIG. 18 is a side view of the handle of the overflow adapter of FIG. 11.
Figure 19:
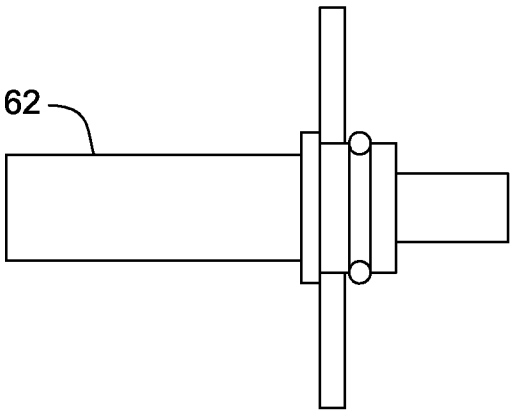
FIG. 19 is a top view of a handle shaft of the overflow adapter of FIG. 11.
Figure 20:
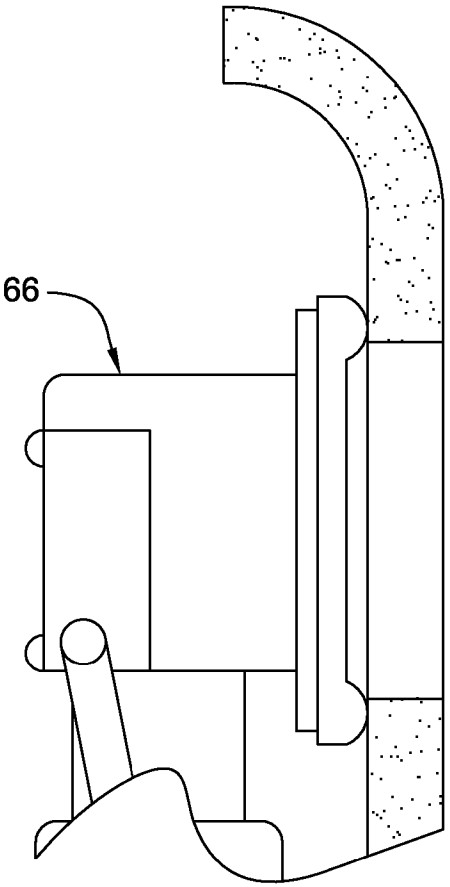
FIG. 20 is a side view of the drain overflow of FIG. 11.
Figure 21:
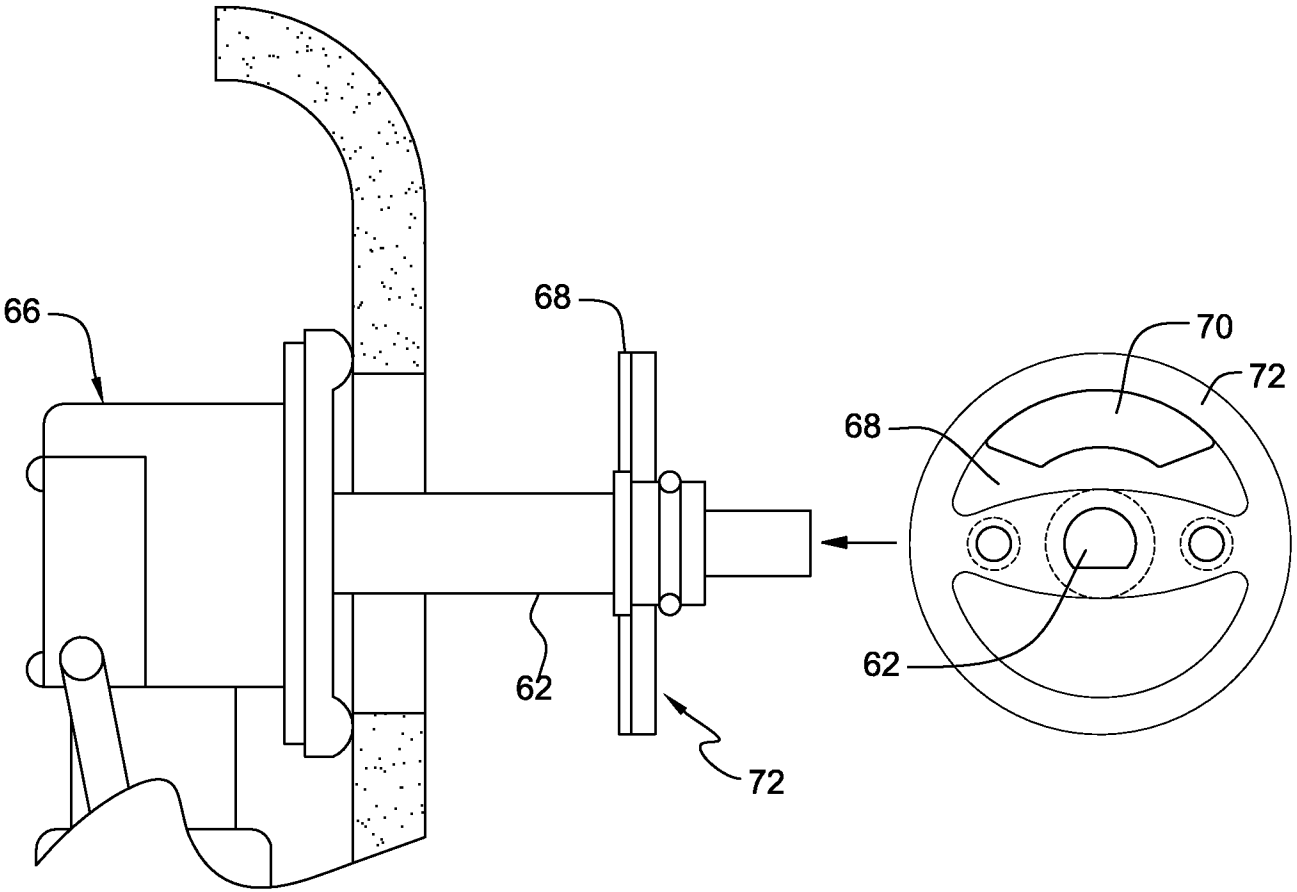
FIG. 21 is a side view of the overflow plate, the overflow disk, fasteners, the handle shaft of the overflow adapter of FIG. 11 as the overflow adapter is being fastened to the drain overflow of FIG. 11 and a top view of the overflow plate, the overflow disk, the fasteners, and the handle shaft as the overflow adapter is being fastened to the drain overflow of FIG. 11.
Figure 22:
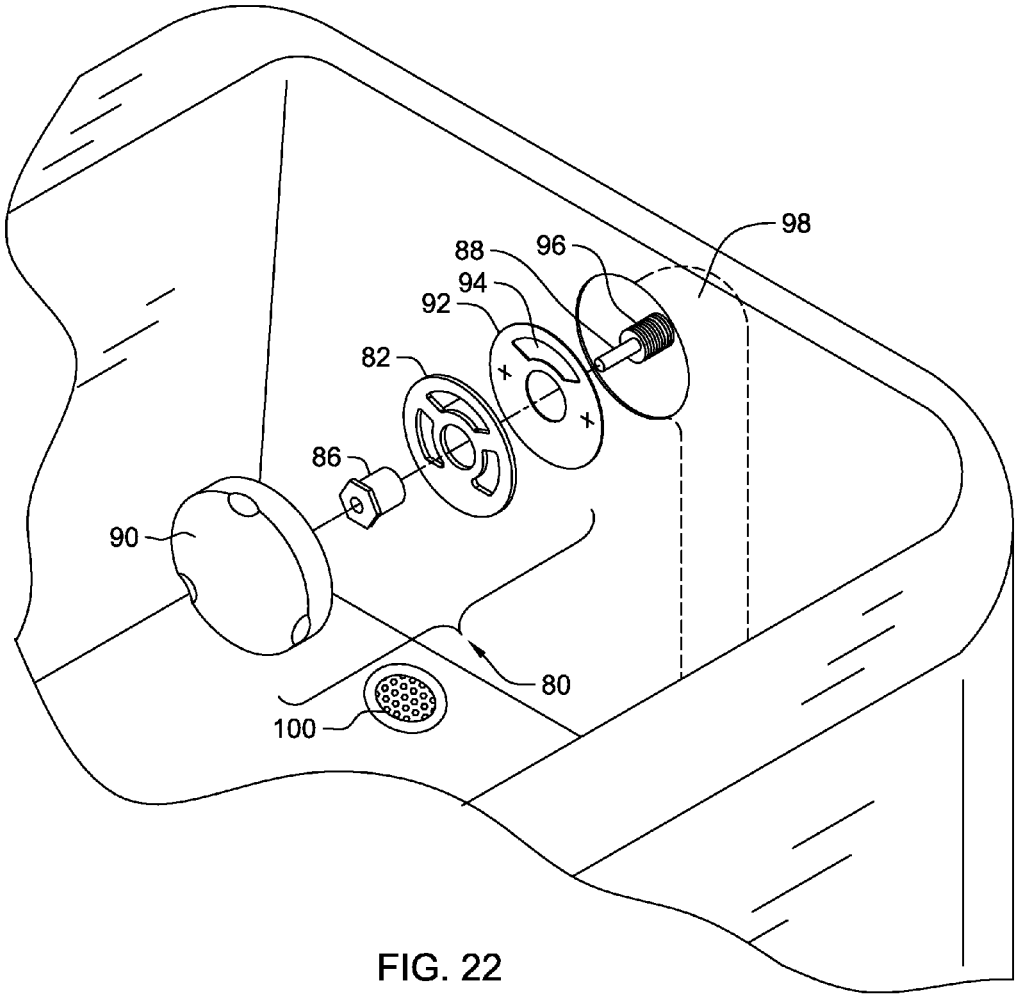
FIG. 22 is an exploded perspective view of another alternate embodiment of an overflow adapter and another alternate embodiment of a drain overflow installed in yet another bathtub.
Figure 23:
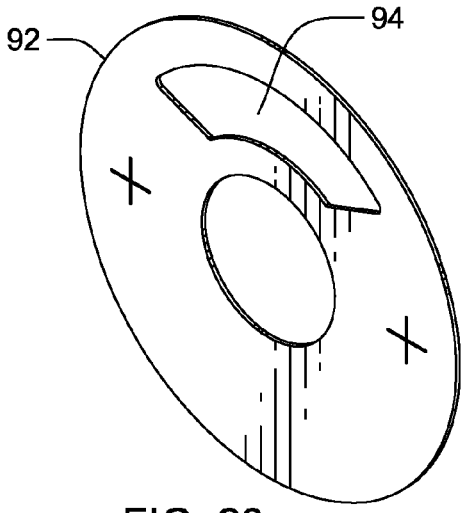
FIG. 23 is a perspective view of an overflow disk of FIG. 22.
Figure 24:
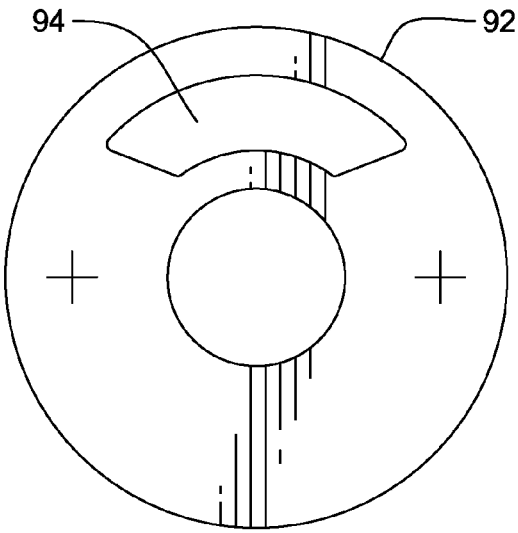
FIG. 24 is a front view of the overflow disk of FIG. 22.
Figure 25:
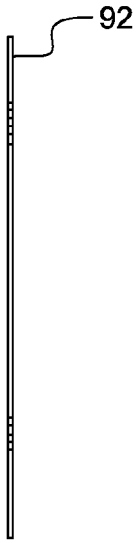
FIG. 25 is a side view of the overflow disk of FIG. 22.
Figure 26:
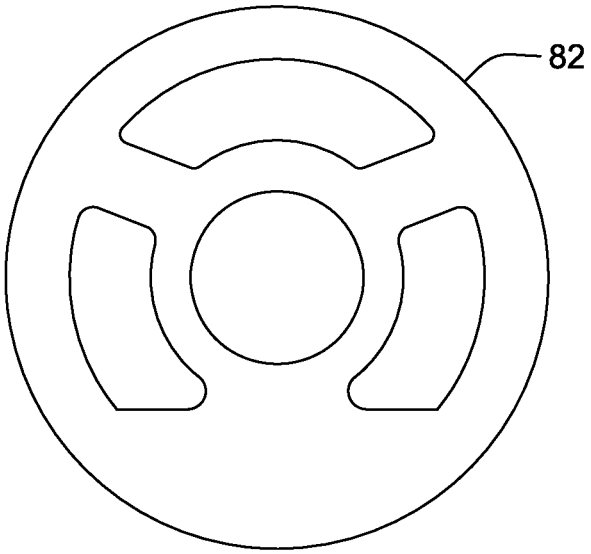
FIG. 26 is a front view of an overflow plate of FIG. 22.
Figure 27:
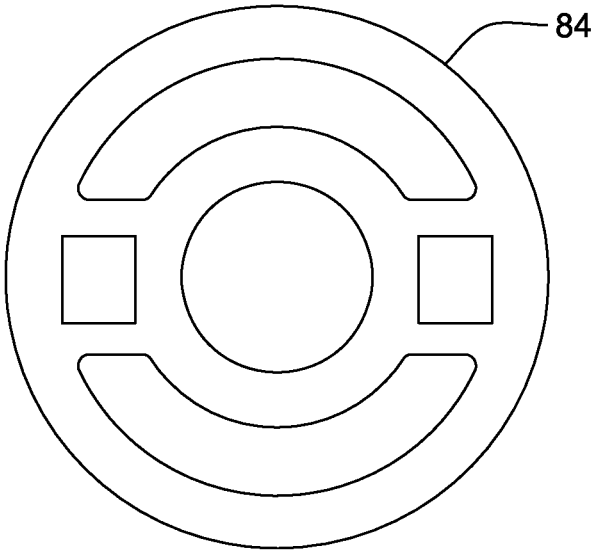
FIG. 27 is a front view of an alternate overflow plate, which may alternately be used with the alternate embodiment of the overflow adapter of FIG. 22.
Figure 28:
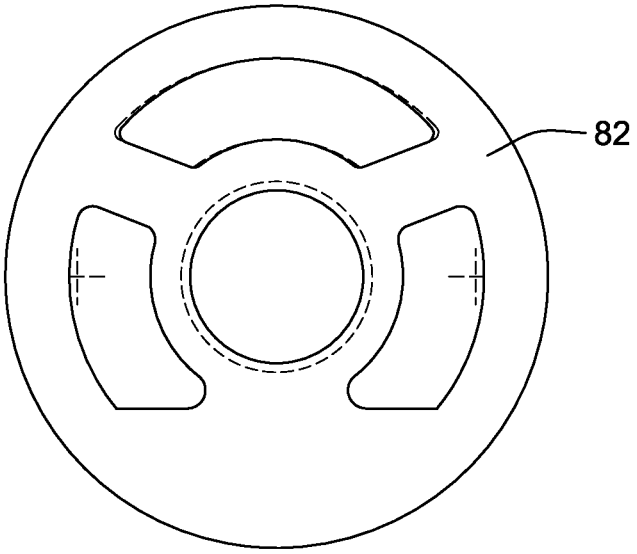
FIG. 28 is a front view of the overflow plate of FIG. 26 mounted on the overflow disk of FIG. 22.
Figure 29:
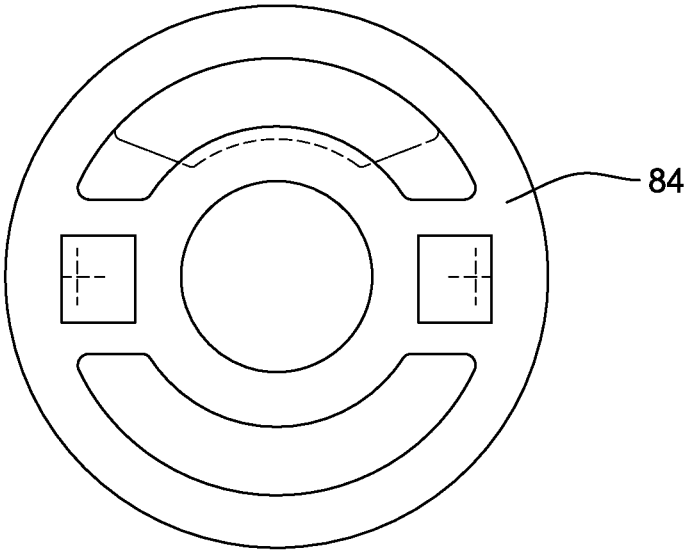
FIG. 29 is a front view of the overflow plate of FIG. 27 mounted on the overflow disk of FIG. 22.
Figure 30:
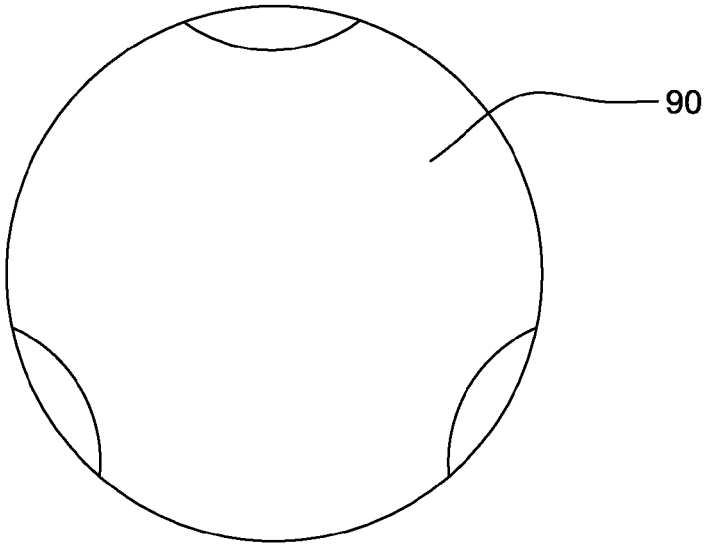
FIG. 30 is a front view of a handle of the overflow adapter of FIG. 22.
Figure 31:
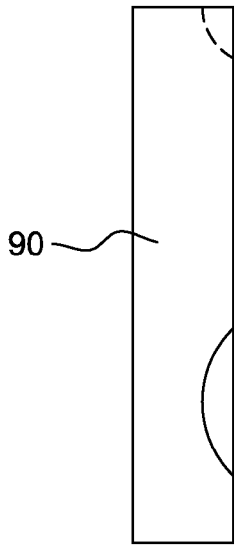
Figure 32:
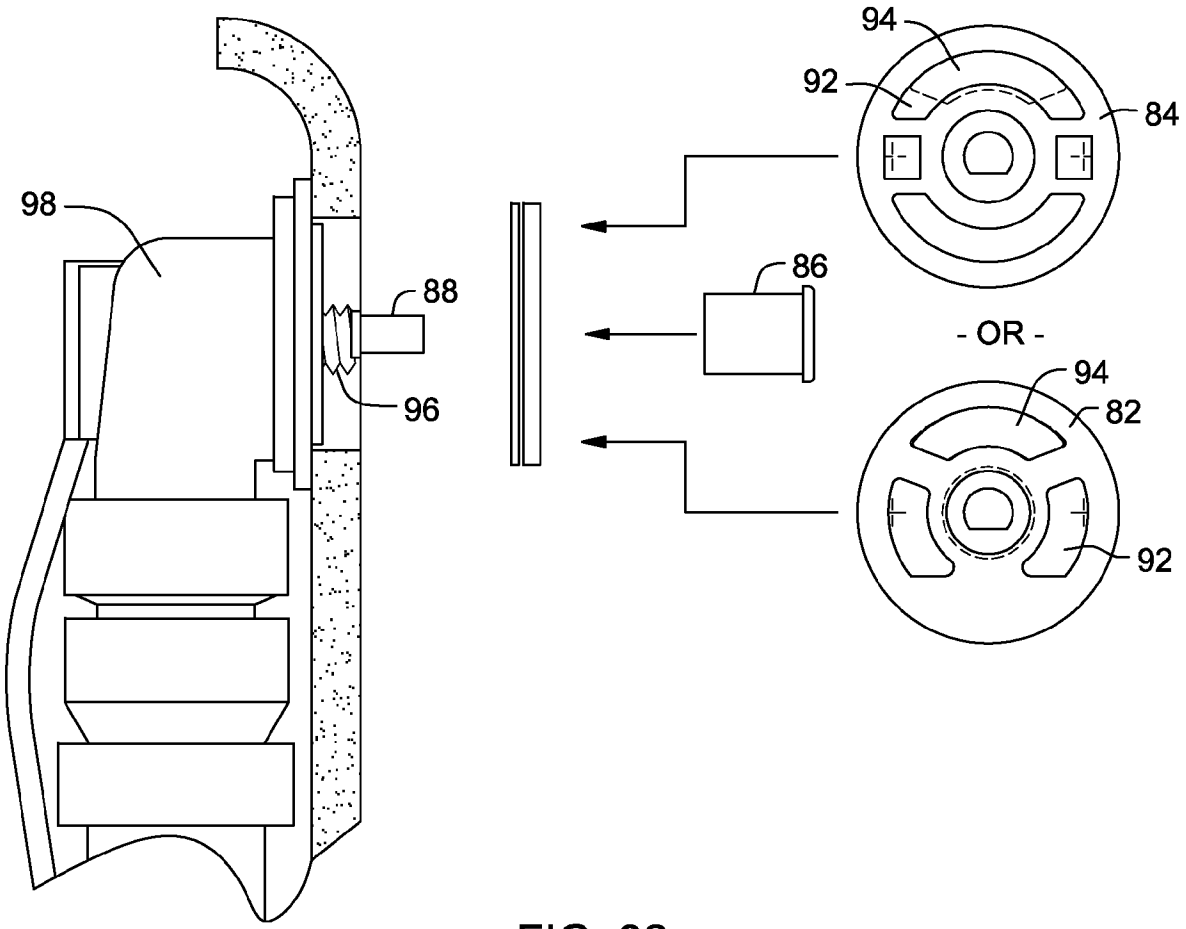

FIG. 31 is a side view of the handle of the overflow adapter of FIG. 22; and FIG. 32 is a side view of the overflow plate, the overflow disk, and ferrule of the overflow adapter of FIG. 22 as the overflow adapter is being fastened to the drain overflow of FIG. 22 and a top view of the alternate overflow plates of FIGS. 27 and 28 that may be used, the overflow disk, and the ferrule as the overflow adapter is being fastened to the drain overflow of FIG. 11.

DESCRIPTION

The preferred embodiments of the present invention will be described with reference to FIGS. 1-32 of the drawings. Identical elements in the various figures are identified with the same reference numbers.

FIGS. 1-10 show an embodiment of the present invention, an overflow adapter 10 for use with drain overflow 12. The overflow adapter 10 has overflow disk 14, overflow plate 16, and trim cap 18.

The overflow disk 14 has overflow opening 20, which has opposing substantially concentric arcuate edges 22 and 24 and opposing transverse edges 26 transverse to the opposing substantially concentric arcuate edges 22 and 24, the opposing substantially concentric arcuate edges 22 and 24 and the opposing transverse edges 26 defining the overflow opening 20. The overflow disk 14 also has substantially centrally disposed hole 28 for receiving fastener 30 therethrough and opposing cross hair slots 32 adapted to be punctured and receive fasteners 34 therethrough.

The overflow plate 16 has upper and lower opposing openings 28 and 29, respectively, which are substantially the same shape and size, opposing holes 30 for receiving the fasteners 34 therethrough, and substantially centrally disposed hole 36 for receiving the fastener 30 therethrough.

The drain overflow 12 is mounted in bathtub 38 interior to walls 40 and 42 of the bathtub 38, and has receiving fasteners 44 for matingly receiving the fasteners 34 and fastening the overflow adapter 10 thereto.

The overflow disk 14 is sandwiched between the overflow plate 16 and edges 46 of the wall 40 of the bathtub 38, when the fasteners 34 are inserted into the receiving fasteners 44 and fastened to the drain overflow 12, the overflow disk 14 abutting the edges 46 of the wall 40 of the bathtub 38 and the overflow opening 20 of the overflow disk 14 open to the upper opening 28 of the overflow plate 16 and entrance 49 to interior portion 50 of the drain overflow 12.

The drain overflow 12 has substantially centrally disposed receiving fastener 52 for matingly receiving the fastener 30, which has head 54 for fastening the trim cap 18 thereto, when the fastener 30 is fastened to the substantially centrally disposed receiving fastener 52, the trim cap 18 covering the overflow disk 14 and the overflow plate 16, when assembly of the overflow adapter 10 is complete. The trim cap 18 has receptacle 55 for matingly receiving the head 54 of the fastener 30.

The drain overflow 12 has the entrance 49 for receiving excess water and emptying the excess water from the bathtub 38 into the drain overflow 12 for discharge from the bathtub 38, when drain 58 of the bathtub 38 is closed.

The excess water may be discharged from the bathtub from behind the trim cap 18 through the upper opening 28 of the overflow plate 16, through the overflow opening 20 of the overflow disk 14, through the entrance 49 of the drain overflow 12, and into the interior portion 50 of the drain overflow 12, the excess water being drained from the bathtub 38, the water level above which the excess water will be drained and the volume of the excess water being drained being defined by the height and shape of the overflow disk 14, when the drain 58 of the bathtub 38 is closed.

The overflow disk 14 is preferably of polyethylene or other suitable material. The overflow disk 14 is preferably manufactured from sheet material, the overflow disk 14, the overflow opening 20, the substantially centrally disposed hole 28, and the opposing cross hair slots 32 preferably being die cut from the sheet material. The opposing cross hair slots 32 are typically manufactured as slits in the sheet material. The overflow plate 16 is preferably of brass or other suitable material.

The drain overflow 12 may alternatively or optionally have a drain control for opening and closing the drain 58 of the bathtub 38. FIGS. 11-32 show alternate embodiments of overflow adapters 60 and 80 used in conjunction with drain overflows 66 and 98, respectively, that have drain controls.

FIGS. 11-21 show an alternate embodiment of an overflow adapter 60, which is substantially the same as the overflow adapter 10, except that the overflow adapter 60 is adapted to receive handle shaft 62 for opening and closing drain 64 via drain overflow 66.

The overflow adapter 60 has overflow disk 68 that has overflow opening 70, which is substantially the same shape and size as the overflow opening 20 of the overflow adapter 10, and has substantially the same overflow characteristics.

The overflow adapter 60 has overflow plate 72, which is substantially the same as the overflow plate 16 of the overflow adapter 10, except that the overflow plate 72 is adapted to receive a portion of the handle shaft 62 therethrough, the handle shaft 62 being matingly received in shaft receptacle 74 of the drain overflow 66.

Handle 76 is fastened to the handle shaft 62 to facilitate manipulating the handle shaft 62 for opening and closing the drain 64.

FIGS. 22-32 show another alternate embodiment of an overflow adapter 80, which is substantially the same as the overflow adapter 60, except that the overflow adapter 80 has alternate overflow plates 82 and 84, only one of which is installed depending upon installation requirements, and ferrule 86, which fits about shaft 88 during installation.

The overflow adapter 80 has overflow disk 92, which is substantially the same as the overflow disk 14 of the overflow adapter 10. The overflow disk 92 has overflow opening 94, which is substantially the same shape and size as the overflow opening 20 of the overflow disk 14 of the overflow adapter 10, and has substantially the same overflow characteristics.

The ferrule 86 is matingly received by fastener 96 of drain overflow 98. The ferrule 86 fits about shaft 88 of the drain overflow 98 and is fastened to the fastener 96 to facilitate opening and closing drain 100.

Only one of the alternate overflow plates 82 and 84 is installed during installation of the overflow adapter 80, depending upon installation requirements.

Although the present invention has been described in considerable detail with reference to certain preferred versions thereof, other versions are possible. Therefore, the spirit and scope of the appended claims should not be limited to the description of the preferred versions contained herein.

What is claimed is:

1. An overflow adapter for raising a fluid discharge overflow level of a drain overflow having a drain overflow discharge entrance and a substantially centrally disposed drain overflow connector, the drain overflow installed in a plumbing fixture having a drain, an interior wall having a plumbing fixture overflow exit, and wall edges adjacent the plumbing fixture overflow exit, the drain overflow having an optional drain control attached to and working in conjunction with the substantially centrally disposed drain overflow connector, the optional drain control for opening and closing the drain, the overflow adapter comprising:

an overflow disk having an upper overflow disk discharge opening and a substantially centrally disposed overflow disk hole, the upper overflow disk discharge opening having opposing substantially concentric arcuate edges and opposing transverse edges transverse to the opposing substantially concentric arcuate edges, the opposing substantially concentric arcuate edges and the opposing transverse edges defining the upper overflow disk discharge opening;

an overflow plate having an upper overflow plate hole at least as large as the upper overflow disk discharge opening of the overflow disk, and a substantially centrally disposed overflow plate hole;

overflow adapter fasteners, the overflow adapter fasteners fastening the overflow plate to the drain overflow and sandwiching the overflow disk between the overflow plate and the wall edges adjacent the plumbing fixture overflow exit, the upper overflow disk discharge opening aligned with the upper overflow plate hole, which is at least as large as the upper overflow disk discharge opening, causing any fluid discharge to be discharged through the upper overflow plate hole, through the upper overflow disk discharge opening, thus raising the fluid discharge overflow level of the drain overflow, through the plumbing fixture overflow exit, and into the drain overflow discharge entrance;

a shaft having opposing ends, the shaft inserted through the substantially centrally disposed overflow plate hole, through the substantially centrally disposed overflow disk hole, one of the opposing ends of the shaft fastened to the substantially centrally disposed drain overflow connector;

a cover, the cover fastened to the shaft at another of the opposing ends of the shaft and covering the overflow plate, the overflow disk, the wall edges adjacent the plumbing fixture overflow exit, and the drain overflow, the cover comprising a handle fastened to and working in conjunction with the shaft, the substantially centrally disposed drain overflow connector, and the optional drain control, when the optional drain control is installed in the drain overflow and used for opening and closing the drain.

2. The overflow adapter according to claim 1, wherein:

the plumbing fixture is from the group consisting of a plumbing fixture, a shower, a bathtub, and a sink.

3. An overflow adapter for raising a fluid discharge overflow level of a drain overflow having a drain overflow discharge entrance, opposing drain overflow fasteners, and a substantially centrally disposed drain overflow fastener, the drain overflow installed in a plumbing fixture having a drain, an interior wall having a plumbing fixture overflow exit, and wall edges adjacent the plumbing fixture overflow exit, the overflow adapter comprising:

an overflow disk having an upper overflow disk discharge opening, a substantially centrally disposed overflow disk hole, and opposing substantially perpendicular slits, the upper overflow disk discharge opening having opposing substantially concentric arcuate edges and opposing transverse edges transverse to the opposing substantially concentric arcuate edges, the opposing substantially concentric arcuate edges and the opposing transverse edges defining the upper overflow disk discharge opening;

an overflow plate having an upper overflow plate hole at least as large as the upper overflow disk discharge opening of the overflow disk, a substantially centrally disposed overflow plate hole, and opposing overflow disk holes; overflow adapter fasteners, the overflow adapter fasteners fastening the overflow plate to the drain overflow and sandwiching the overflow disk between the overflow plate and the wall edges adjacent the plumbing fixture overflow exit, the overflow adapter fasteners inserted into and through the opposing overflow disk holes through the opposing substantially perpendicular slits of the overflow disk and fastened to the opposing drain overflow fasteners, sandwiching the overflow disk between the overflow plate and the wall edges adjacent the plumbing fixture overflow exit, the upper overflow disk discharge opening aligned with the upper overflow plate hole, which is at least as large as the upper overflow disk discharge opening, causing any fluid discharge to be discharged through the upper overflow plate hole, through the upper overflow disk discharge opening, thus raising the fluid discharge overflow level of the drain overflow, through the plumbing fixture overflow exit, and into the drain overflow discharge entrance;

a shaft having opposing ends, the shaft inserted through the substantially centrally disposed overflow plate hole, through the substantially centrally disposed overflow disk hole, one of the opposing ends of the shaft fastened to the substantially centrally disposed drain overflow fastener;

a cover, the cover fastened to another of the opposing ends of the shaft, covering the overflow plate, the overflow disk, the wall edges adjacent the plumbing fixture overflow exit, and the drain overflow.

4. The overflow adapter according to claim 3, wherein:

the plumbing fixture is from the group consisting of a plumbing fixture, a shower, a bathtub, and a sink.

5. The overflow adapter according to claim 3, wherein:

the cover comprises a trim cap.

6. An overflow adapter for raising a fluid discharge overflow level of a drain overflow having a drain overflow discharge entrance, opposing drain overflow fasteners, and a substantially centrally disposed drain overflow connector, the drain overflow installed in a plumbing fixture having a drain, an interior wall having a plumbing fixture overflow exit, and wall edges adjacent the plumbing fixture overflow exit, the drain overflow having a drain control attached to and working in conjunction with the substantially centrally disposed drain overflow connector, the drain control for opening and closing the drain, the overflow adapter comprising:

an overflow disk having an upper overflow disk discharge opening, a substantially centrally disposed overflow disk hole, and opposing substantially perpendicular slits, the upper overflow disk discharge opening having opposing substantially concentric arcuate edges and opposing transverse edges transverse to the opposing substantially concentric arcuate edges, the opposing substantially concentric arcuate edges and the opposing transverse edges defining the upper overflow disk discharge opening;

an overflow plate having an upper overflow plate hole at least as large as the upper overflow disk discharge opening of the overflow disk, a substantially centrally disposed overflow plate hole, and opposing overflow disk holes; overflow adapter fasteners, the overflow adapter fasteners fastening the overflow plate to the drain overflow and sandwiching the overflow disk between the overflow plate and the wall edges adjacent the plumbing fixture overflow exit, the overflow adapter fasteners inserted into and through the opposing overflow disk holes through the opposing substantially perpendicular slits of the overflow disk and fastened to the opposing drain overflow fasteners, sandwiching the overflow disk between the overflow plate and the wall edges adjacent the plumbing fixture overflow exit, the upper overflow disk discharge opening aligned with the upper overflow plate hole, which is at least as large as the upper overflow disk discharge opening, causing any fluid discharge to be discharged through the upper overflow plate hole, through the upper overflow disk discharge opening, thus raising the fluid discharge overflow level of the drain overflow, through the plumbing fixture overflow exit, and into the drain overflow discharge entrance;

a shaft having opposing ends, the shaft inserted through the substantially centrally disposed overflow plate hole, through the substantially centrally disposed overflow disk hole, one of the opposing ends of the shaft fastened to the substantially centrally disposed drain overflow connector;

a handle, the handle fastened to the shaft at another of the opposing ends of the shaft, covering the overflow plate, the overflow disk, the wall edges adjacent the plumbing fixture overflow exit, and the drain overflow, the handle fastened to and working in conjunction with the shaft, the substantially centrally disposed drain overflow connector, and the drain control for opening and closing the drain.

7. The overflow adapter according to claim 6, wherein:

the plumbing fixture is from the group consisting of a plumbing fixture, a shower, a bathtub, and a sink.

8. The overflow adapter according to claim 6, wherein:

the substantially centrally disposed drain overflow connector comprises a threaded fastener.

9. The overflow adapter according to claim 8, wherein:

the overflow adapter further comprises a ferrule fastened to the shaft and the threaded fastener.

10. The overflow adapter according to claim 6, wherein:

the substantially centrally disposed drain overflow connector comprises a shaft receptacle.

* * * * *